United States Patent [19]

Kitamura

[11] Patent Number: 4,564,481

[45] Date of Patent: Jan. 14, 1986

[54] APPARATUS FOR STARTING AND WARMING UP AN INTERNAL COMBUSTION ENGINE

[75] Inventor: Sunao Kitamura, Ohbu, Japan

[73] Assignee: Aisan Kogyo Kabushiki Kaisha, Ohbu, Japan

[21] Appl. No.: 654,662

[22] Filed: Sep. 26, 1984

[30] Foreign Application Priority Data

Oct. 19, 1983 [JP] Japan ..... 58-161540[U]

[51] Int. Cl.[4] ..... F02M 1/10

[52] U.S. Cl. ..... 261/39 A; 261/65

[58] Field of Search ..... 261/39 A, 65, 39 B, 261/52

[56] References Cited

U.S. PATENT DOCUMENTS 2,102,428 12/1937 MacAuley, Jr. et al. ..... 261/39 B
3,943,206 3/1976 Schubeck ..... 261/65
4,196,156 4/1980 Rogerson et al. ..... 261/52

FOREIGN PATENT DOCUMENTS 55-28856 7/1980 Japan .
807246 1/1959 United Kingdom ..... 261/39 B

*Primary Examiner*—Tim Miles
*Attorney, Agent, or Firm*—Cushman, Darby & Cushman

[57] ABSTRACT

An apparatus for controlling the opening degree of a throttle valve during starting and warming up of an internal combustion engine, has the following constituents: a fast idle cam which operates to progressively decrease the opening degree of the throttle valve as the warming up of the engine proceeds; a starting cam provided separately from the fast idle cam and adapted to maintain a large opening degree of the throttle valve; a first means for bringing, while the engine is not operating, the starting cam into operative position for holding the throttle valve, in response to a throttle opening operation; and a second means for releasing, when a predetermined engine temperature is reached after the starting of the engine, the holding of the throttle valve by the starting cam and insteadly bringing the fast idle cam into operation for controlling the opening degree of the throttle valve.

4 Claims, 3 Drawing Figures

APPARATUS FOR STARTING AND WARMING UP AN INTERNAL COMBUSTION ENGINE

BACKGROUND OF THE INVENTION

The present invention relates to an apparatus for starting and warming up an internal combustion engine adapted to suitably control the opening degree of a throttle valve during starting and warming up of the internal combustion engine.

Japanese Utility Model Publication No. 28856/1980 discloses an example of the apparatus for controlling the opening degree of a throttle valve during starting and warming up of an internal combustion engine. This apparatus has a heat-sensitive body adapted to change its volume in response to a change in the temperature of, for example, the engine cooling water, or in response to heat generated by an electric heat generating member. This heat-sensitive body engages with a fast idle cam which in turn engages with a throttle lever so as to bias the throttle valve in the closing direction. As the warming up of the engine proceeds to increase the temperature of the engine, the heat-sensitive body increases its volume to gradually decrease the opening degree of the throttle valve, thereby reducing the idle speed of the engine. In this known apparatus, the control cam contour of the fast idle cam for engaging with the throttle lever is as shown in FIG. 1. Namely, the cam contour A has an arcuate configuration, the radial distance of which from the shaft 7 rotatably carrying the cam is progressively decreased. This cam contour A is effective in controling the opening degree of the throttle valve during the warming up of the engine. Unfortunately, however, when the engine is left in the inoperative condition for a long period of time under normal atmospheric temperature conditions, the engine temperature is gradually raised to turn the fast idle cam 11 counter-clockwise as viewed in the drawings, by the expansion of the heat-sensitive body, so that the throttle lever 4 is rotated in the valve closing direction to reduce the opening degree of the throttle valve. In consequence, the engine speed is excessively lowered during the starting and warming up of the engine to take a lot of time till the completion of the warming up of the engine, thus causing not only an uneconomical use of the fuel but also an increase of noxious exhaust emission due to delay of the heating up of the exhaust gas cleaning system.

SUMMARY OF THE INVENTION

Accordingly, it is a primary object of the invention to overcome the above-described problems of the prior art.

It is another object of the invention to improve rate of fuel consumption and eliminate an increase of noxious exhaust gases by increasing an engine speed during the starting and warming-up of the engine in normal temperature conditions in low temperature conditions and thus reducing a period of time for warming-up.

To these ends, according to the invention, there is provided an apparatus for controlling the opening degree of a throttle valve during starting and warming up of an internal combustion engine, having a fast idle cam which operates to progressively decrease the opening degree of the throttle valve as the warming up of the engine proceeds, the apparatus comprising: a starting cam provided separately from the fast idle cam and adapted to maintain a large opening degree of the throttle valve; a first means for bringing, while the engine not operating, the starting cam into operative position for holding the throttle valve, in response to a opening operation of the throttle valve; and a second means for releasing, when a predetermined engine temperature is reached after the starting of the engine, the holding of the throttle valve by the starting cam and instead bringing the fast idle cam into operation for controlling the throttle valve.

These and other objects, features and advantages of the invention will become clear from the following description of the preferred embodiments taken in conjunction with the accompanying drawings.

DESCRIPTION OF THE PREFERRED EMBODIMENT

Figure 1:
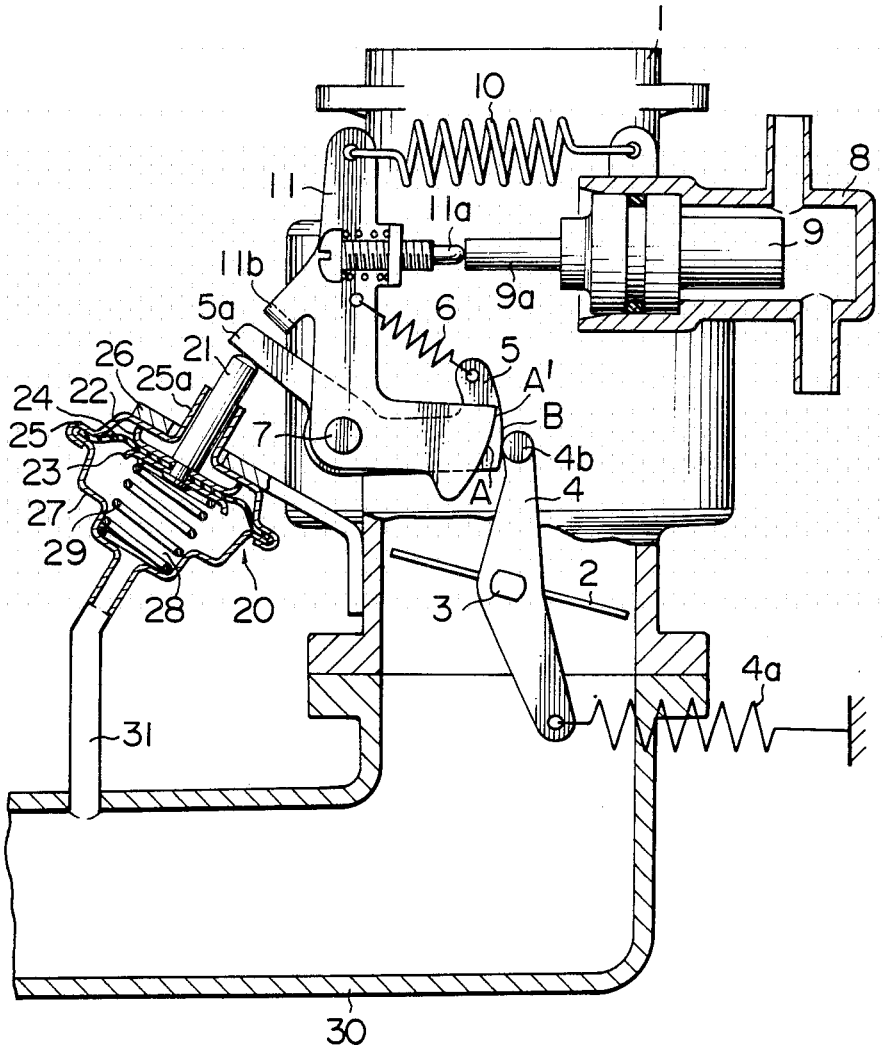
FIG. 1 is a sectional view of an embodiment of the invention showing the state in which a throttle valve is kept opened by a starting cam.

Referring to FIG. 1, reference numerals 1 and 2 denote, respectively, a carburetor and a throttle valve which are known per se. A throttle lever designated by reference numeral 4 is fixed at its intermediate portion to the end of a throttle shaft 3. The throttle lever 4 is provided at its one end with a back spring **4*a* which biases the throttle lever 4 in the direction for closing the throttle valve 2. An engaging portion 4*b* formed on the other end of the throttle lever 4 is adapted to engage a later-mentioned fast idle cam 11 or a starting cam 5 so as to control the opening of the throttle valve 2. A heat-sensitive body 9 is accommodated by a casing 8 into which engine cooling water is introduced. The heat sensitive body 9 is adapted to contract so as to decrease its volume, thus retracting a rod 9*a* to the right as viewed in the drawings. On the other hand, the rod 9*a*** is extended to the left as viewed in the drawing, as the cooling water temperature is raised.

The fast idle cam 11 mentioned before is supported rotatably by a support shaft 7. The fast idle cam 11 is provided at its one end with a pin **11*a* engaging the tip end of the rod 9*a* of the heat-sensitive body 9 and at its other end with a control surface A for engagement with the engaging portion 4*b* of the throttle lever 4. Reference numeral 10 designates a back spring which is engaged at its one end by the fast idle cam 11 and at its other end by the body of the carburetor 1. The back spring 10 biases the fast idle cam 11 around the support shaft 7 in a clockwise direction. The control surface A has such an arcuate contour that, as the heat-sensitive body 9 is thermally expanded to project its rod 9*a* to the left, the fast idle cam 11 is rotated counter-clockwise as viewed in the drawings thereby to move the throttle lever 4 engaged by the control surface A to progressively close the throttle valve 2. Thus, the contour of the control surface A is materially the same as that in the conventional apparatus. The one leg of the fast idle cam 11 carrying the aforementioned pin 11*a* is integrally formed with an engaging projection 11*b***.

The starting cam 5 is rotatably supported by the support shaft 7 and is provided at its one end with a starting control surface B adapted for engagement with the engaging portion 4*b* of the aforementioned throttle lever 4. An engaging arm 5*a* adapted for engaging the engaging projection 11*b* on the fast idle cam 11 is integrally formed on the other end of the starting cam 5. The starting control surface B of the starting cam 5 has an arcuate contour of a substantially constant radius about the support shaft 7, which radius is substantially equal to the radial distance between the axis of the support shaft 7 and a point A' where the control surface A of the fast idle cam 11 engages the throttle valve 2 through the medium of the throttle lever 4 in the cold state, i.e., the point where the fast idle cam 11 opens the throttle valve 2 to the maximum opening degree. A relief spring 6 is extended between the starting control surface B of the starting cam 5 and the portion of the fast idle cam 11 adjacent the pin 11*a* or the body of the carburetor 1, so as to bias the starting cam 5 in the counter-clockwise direction, as viewed in the drawings.

Reference numeral 20 designates a diaphragm device comprising a diaphragm 24 clamped at its peripheral portion between an upper cover 25 and a lower cover 27 and having its central portion interposed between shells 22 and 23. A rod 21 slidably extending through the upper cover 25 is fixed at its one end to the central portions of the diaphragm 24 and shells 22, 23 assembled in layers. The diaphragm device 20 further includes a diaphragm spring 29 disposed in a vacuum chamber 28. The diaphragm device 20 as a whole is mounted with its upper cover 25 fixed to a stay 26 on the body of the carburetor 1, such that the tip end of the rod 21 abuts the engaging arm 5*a* of the starting cam 5. The vacuum chamber 28 is communicated through a vacuum passage 31 with an intake pipe 30 which in turn provides communication between the intake passage of the carburetor 1 and the engine. The spring constant of the diaphragm spring 29 and the relief spring 6 are so selected that the compression load produced by the diaphragm spring 29 overcomes the tension load produced by the relief spring 6.

Figure 2:
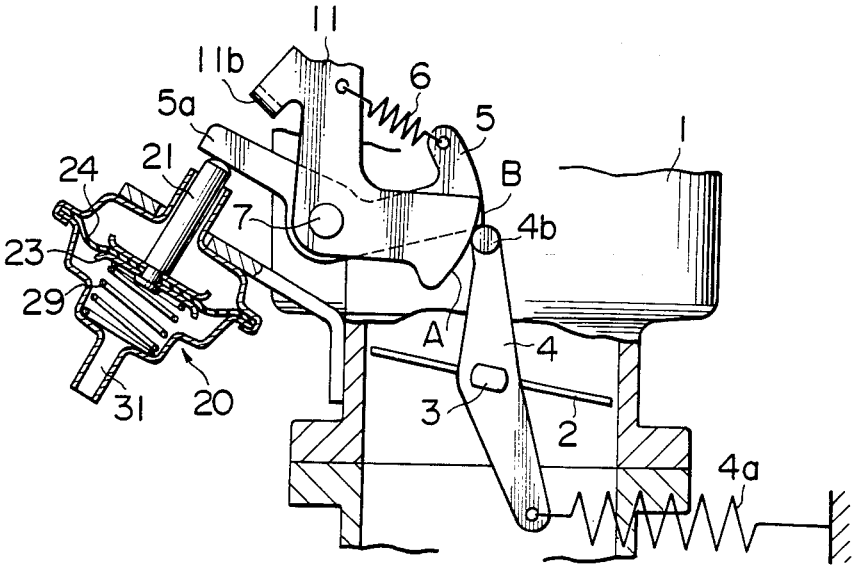
FIG. 2 is a fragmentary sectional view of the embodiment shown in FIG. 1, in the state in which the engine is stopped.

When the engine is operating, intake negative pressure established in the intake passage causes the rod 21 to be retracted against the force of the diaphragm spring 29, so that the starting cam 5 is rotated counterclockwise by the leaf spring 6 to keep away from the engaging portion 4*b* of the throttle lever 4. In this state, the throttle lever 4 is controlled by the control surface A of the fast idle cam 11. When the engine is stopped, the intake negative pressure is lost, so that the rod 21 is projected by the force of the diaphragm spring 29 to turn the starting cam 5 clockwise. This rotation of the starting cam 5, however, is limited in the manner as shown in FIG. 2 because the cam is engaged by the engaging portion 4*b* of the throttle lever 4 which in turn is engaged by the control surface A of the fast idle cam 11. The fast idle cam 11 takes a position corresponding to the temperature of the engine since the heat-sensitive body 9 changes its volume depending upon the temperature of the engine cooling water.

Figure 3:
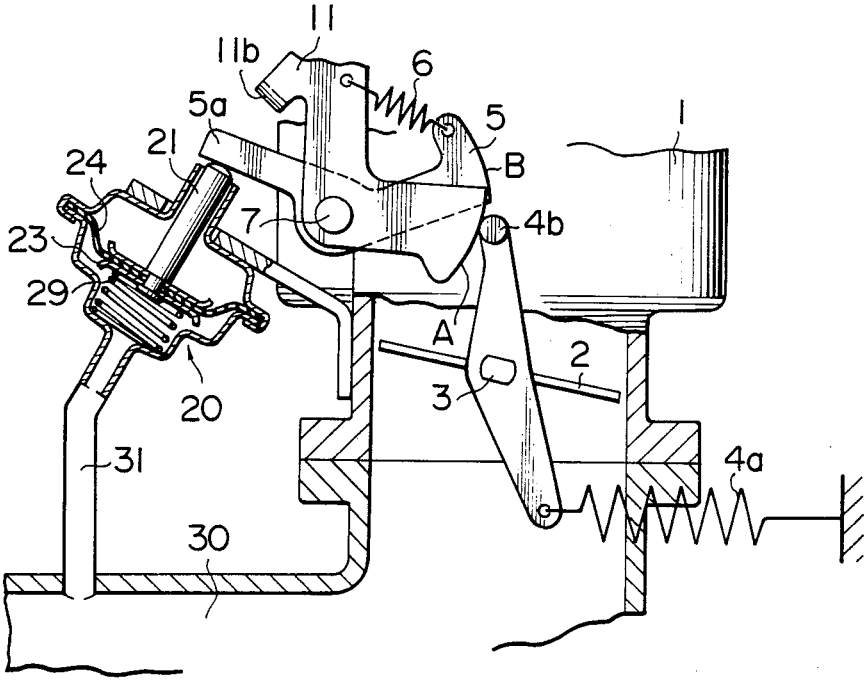
FIG. 3 is a fragmentary sectional view of the embodiment in the state during warming up of the engine after the starting cam has been moved out of engagement with the throttle valve.

An explanation will be made hereinunder as to how the apparatus operates when the engine is restarted. As the accelerator pedal is depressed to prepare for the starting of the engine, the throttle lever 4 is rotated in the opening direction so that its engaging portion is moved away from the starting control surface B on the starting cam 5. In consequence, the starting cam 5 is released from the throttle lever 4 to be rotated clockwise, as viewed in the drawings, through the action of the rod 21 by the force of the diaphragm spring 29, which is stronger than the relief spring 6, so that the starting control surface B comes to face the engaging portion 4*b* of the throttle lever 4, as shown in FIG. 1. The amount of rotation of the starting cam 5 is limited as the shell 22 of the diaphragm device 20 contacts the inner surface of the upper cover 25. After the accelerator pedal is depressed, the rotation of the throttle lever 4 in the counter-clockwise direction, i.e., in the throttle closing direction, caused by the force of the throttle back spring 4*a* is stopped by the starting control surface B of the starting cam 5. In consequence, the throttle valve is allowed to be opened to an opening degree which is greater than that allowed by the control surface A of the idle cam 11. The engine is now ready to start. As the engine starts and idles for the warming up, intake negative pressure is produced in the intake passage and transmitted through the vacuum passage 31 to the vacuum chamber 28 in the diaphragm device 20. This negative pressure produces a force which acts to retract the diaphragm 24 and the shells 22, 23 against the force of the diaphragm spring 29 until the shell 23 abuts against the inner surface of the lower cover 27. Consequently, the rod 21 is retracted correspondingly, so that its tip end is moved away from the engaging arm 5*a* of the starting cam 5. In this state, although the relief spring 6 tends to rotate the starting cam 5 counter-clockwise, as viewed in the drawings, the starting cam 5 is held in its position without making any rotation because the throttle back spring 4*a* produces a force biassing the engaging portion 4*b* of the throttle lever 4 onto the starting control surface B of the starting cam 5. Therefore, the opening degree of the throttle valve 2 is maintained sufficiently large to give a high engine speed during warming up to shorten a warming-up time taken for raising the temperature of the engine to a predetermined level. As the accelerator pedal is depressed again to rotate the throttle lever 4 in the opening direction, the force for having the engaging portion 4*b* engaging with the starting control surface B is lost so that the starting cam 5 is rotated counter-clockwise, as viewed in the drawings, by the force of the relief spring 6, until its engaging arm 5*a* is stopped by the end of the rod 21, which is in the retracted position, as shown in FIG. 3. Consequently, the starting control surface B of the starting cam 5 is moved away from the engaging portion 4*b* of the throttle lever 4, so that the throttle lever 4 is rotated in the throttle closing direction until its engaging portion 4*b* is stopped by the control surface A of the fast idle cam 11. Therefore, a subsequent control of the opening degree of the throttle valve 2 is effected by the control surface A of the throttle cam 11. In this case, therefore, the operation of the engine during the warming up is controlled by the fast idle cam 11 as in the conventional apparatus. If the warming up of the engine is continued without depressing of the accelerator pedal, the fast idle cam 11 is rotated counter-clockwise owing to the volumetric expansion of the heat-sensitive body 9 which is resulted from the engine warming-up. When a predetermined engine temperature is reached, the engaging projection 11*b* of the fast idle cam 11 comes into contact with the engaging arm 5*a* of the starting cam 5 to rotate the starting cam 5 counter-clockwise against the biasing force exerted by the engaging portion 4*b* on the starting control surface B, thereby disengaging the starting control surface B from the engaging portion 4*b*. Accordingly, even if the accelerator pedal fails to be depressed during the warming-up of the engine, it is possible to automatically stop the warming-up operation under the control of the starting cam and to switch over to the normal mode under the control of the fast idle cam 11.

As will be understood from the foregoing description, the present invention presents the following advantages.

Namely, since the starting cam 5 can set a sufficiently large opening degree of the throttle valve 2 during the starting and warming-up of the engine regardless of the engine temperature, it is possible to maintain sufficiently high engine speed during the starting and warming-up of the engine even at a normal temperature which is higher than the cold state engine temperature, so that the time length required for warming up the engine can be shortened to reduce the fuel consumption and to improve the condition of the exhaust emission.

In addition, it is to be noted that the provision of the starting cam 5 does not impede the control of the warming up of the engine. This is because the starting cam 5 functions only during the starting and warming-up of the engine until the warming-up operation mode under the control of the starting cam is stopped by the actuation of the accelerator pedal, and the fast idle cam 11 is then put into operation to control the opening degree of the throttle valve. Thus, after the starting cam is caused to become inactive, the throttle valve can be controlled in a conventional manner by the fast idle cam 11 of which behavior is varied dependent upon the engine temperature.

Furthermore, the control mode from the first mode under the control of the starting cam 5 is automatically switched over to the second mode controlled by the fast idle cam 11 when a predetermined engine temperature is reached. Accordingly, even if the driver fails to depress the accelerator pedal, the engine can be safely prevented from continuing to operate at a high speed.

What is claimed is:

1. An apparatus for controlling the opening degree of a throttle valve during starting and warming up of an internal combustion engine, having a fast idle cam which operates to progressively decrease the opening degree of the throttle valve as the warming up of the engine proceeds, said apparatus comprising:

a starting cam provided separately from said fast idle cam and adapted to maintain a large opening degree of said throttle valve;

a first means for bringing, while the engine is not operating, said starting cam into operative position for holding said throttle valve, in response to a throttle opening operation;

a second means for releasing, when a predetermined engine temperature is reached after the starting of said engine, the holding of said throttle valve by said starting cam and instead bringing said fast idle cam into operation for controlling the opening degree of the throttle valve, and a throttle lever having a cam engaging portion, said starting cam and said fast idle cam being mounted in side-by-side relationship on opposite sides of an intermediate plane, with each cam engaging said throttle lever portion on opposite sides of said plane.

2. An apparatus according to claim 1, wherein said first means includes a diaphragm device operative by a negative pressure generated by the operation of said engine, said diaphragm device having a rod adapted to be projected by a diaphragm spring when the engine is not operating, so as to make said starting cam operable as a unit for said throttle valve.

3. An apparatus according to claim 1, wherein said second means includes an engaging projection formed integrally on said fast idle cam, said idle cam being adapted to contact and move said starting cam out of engagement with said throttle lever, when said fast idle cam has been rotated to a position corresponding to said predetermined engine temperature.

4. An apparatus according to claim 1, further comprising a back spring adapted for biasing said throttle lever towards said fast idle cam and said starting cam.

* * * * *